US007699317B2

(12) United States Patent
Eggers

(10) Patent No.: US 7,699,317 B2
(45) Date of Patent: Apr. 20, 2010

(54) HIERARCHICAL, MULTI-DIMENSIONAL, STRATEGY BOARD GAME APPARATUS AND PLAYING METHOD

(76) Inventor: Jay R. Eggers, 5524 Xerxes Ave. South, Edina, MN (US) 55410

( * ) Notice: Subject to any disclaimer, the term of this patent is extended or adjusted under 35 U.S.C. 154(b) by 0 days.

(21) Appl. No.: 11/347,610

(22) Filed: Feb. 3, 2006

(65) Prior Publication Data

US 2006/0175754 A1 Aug. 10, 2006

Related U.S. Application Data

(60) Provisional application No. 60/650,178, filed on Feb. 4, 2005.

(51) Int. Cl.
*A63F 3/00* (2006.01)

(52) U.S. Cl. ..... 273/241; 273/255; 273/262

(58) Field of Classification Search ..... 273/241, 273/287, 290, 260–262, 255, 284
See application file for complete search history.

(56) References Cited

U.S. PATENT DOCUMENTS 3,399,895 A * 9/1968 Beach ..... 273/241
3,481,603 A * 12/1969 Sugden ..... 273/271
3,767,201 A * 10/1973 Harper et al. ..... 273/241
4,249,740 A * 2/1981 Cheney et al. ..... 273/260
4,333,654 A 6/1982 Allain
4,348,027 A 9/1982 Escamilla-Kelly
4,371,169 A 2/1983 Compton
4,643,432 A * 2/1987 Berry et al. ..... 273/260
4,883,278 A 11/1989 Scott
5,004,245 A 4/1991 Schumacher et al.
5,083,791 A * 1/1992 Coombes, Jr. ..... 273/237
5,112,056 A * 5/1992 Ching ..... 273/241
5,443,268 A 8/1995 Mayfield et al.
5,556,099 A * 9/1996 Mardirosian ..... 273/241
5,826,880 A 10/1998 Cooper
5,988,640 A 11/1999 Wheeler
6,170,825 B1 * 1/2001 Pflum ..... 273/261
6,276,685 B1 8/2001 Sterling
6,382,627 B1 5/2002 Lundberg
6,412,778 B1 7/2002 Alaimo
6,543,772 B1 4/2003 Bourdow
2002/0117805 A1 8/2002 Perez
2002/0125634 A1 9/2002 Roy
2002/0149151 A1 10/2002 Denoual
2002/0167128 A1 11/2002 Selman
2003/0030215 A1 2/2003 Mickowski (Continued)

*Primary Examiner*—Vishu K. Mendiratta
(74) *Attorney, Agent, or Firm*—Robert A. Pajak

(57) ABSTRACT

A hierarchical, multi-dimensional, strategy board game apparatus includes game boards having game spaces, posts for supporting the board members, and game pieces including a static piece, a pawn-like piece, a first promotion piece, and a second promotion piece. In playing the game, a base board is designated, along with a riser space, a promotion space, and a return space. Each player starts with a designated number of pieces, and takes turns to move their pieces in prescribed ways via the designated spaces as available. The players thereby attempt to attain higher levels for their pieces with respect to the boards, with means for promotion and demotion of the pieces and an in-hand ability to return them to play via the return space. The pieces may thus gain expanded movement capabilities for capturing other players' pieces and, ultimately, the static piece to win the game.

21 Claims, 7 Drawing Sheets

U.S. PATENT DOCUMENTS

2003/0034606 A1 2/2003 Jacobs
2003/0085518 A1 5/2003 Bedford
2004/0094894 A1 5/2004 Lertdee
2004/0108655 A1 6/2004 Liu
2004/0155406 A1 8/2004 Horrocks
2005/0029735 A1 2/2005 Liu et al.
2005/0029736 A1 2/2005 Liu
2005/0104298 A1 5/2005 Butcher et al.
2005/0179200 A1 8/2005 Roberts
2005/0225032 A1 10/2005 Weinreb
2005/0258594 A1 11/2005 Steenstra et al.

* cited by examiner

140

HIERARCHICAL, MULTI-DIMENSIONAL, STRATEGY BOARD GAME APPARATUS AND PLAYING METHOD

This application claims the benefit of U.S. Provisional Application Ser. No. 60/650,178 filed on Feb. 4, 2005, with the entirety thereof being incorporated herein by reference thereto.

FIELD OF THE INVENTION

The present invention relates generally to board games and their playing methods. The invention relates specifically to a hierarchical, multi-dimensional, strategy board game apparatus and playing method.

BACKGROUND OF THE INVENTION

Board games, sometimes referred to broadly as "parlor games", are well known and have historically enjoyed popularity among game enthusiasts and wide commercial success. Strategy board games such as the well known games of chess and checkers have traditionally been played on a single 8×8 square planar game board totaling 64 equally sized square spaces. In such games, opponents arrange a number of game pieces in predetermined locations on the board and "attack" each other in an effort to capture and remove the opponent's pieces according to well-established rules of play. In chess, individual pieces are designated as having particular movement and capture capabilities. Both chess and checkers allow promotion of a lowest level or basic piece, to a highest level or most powerful piece, once the opposite side of the game board is reached through forward movement of the piece on the board according to established rules of play. In these well known games there are, however, no rules or provisions for allowing demotion of game pieces. Rather, in these games there is only capture and removal of pieces according to the rules. Furthermore, the single game board, singular direction of play, and single promotion of pieces, all create limits to overall strategies and depths of playing the games.

In response to such limitations, three-dimensional and multiple flat game board concepts have been utilized to expand playing areas and necessitate increased complexity in successful game playing strategies as may be desired by those who have developed a modicum of sophistication in playing the games. Often the multiple boards are the same size and generally offer multiple versions of the same basic two-dimensional game, such as provided in the so-called "three-dimensional chess" game made famous by the character "Mr. Spock" in the original Star Trek television series. For example, U.S. Pat. No. 3,767,201 to Harper et al. discloses a game field with multiple levels, which includes elements of tic-tac-toe. U.S. Pat. No. 3,937,471 to Brennan provides a second board for chess and expanded rules of play to have pieces traverse both game boards. Likewise, U.S. Pat. No. 5,112,056 to Ching infuses classic chess with an Egyptian theme and expands the otherwise flat chess game field to a four-tiered pyramid shape. Other varieties of three-dimensional game boards offer designated playing pieces that emphasize piece movements and generally mimic chess piece movement (e.g. of the Rook, Bishop, and Queen pieces) thereby adding vertical movement across several game boards (each typically being identical to the "standard" 64 square game board) to traditional movements on the single game board. In U.S. Pat. No. 6,276,685 to Sterling, a game is disclosed which has designated game pieces that are permitted to move, in play, vertically and diagonally across multiple game boards. U.S. Pat. No. 5,678,818 to Underwood teaches three square game boards and a selection of pieces that are moved like chess pieces across the boards.

In these patented games, the game pieces generally have a static set of functions for the additional cross-board movements, but do not relate piece movement across game boards to promotion of game pieces thereby.

Considering, now, rules of promotion of game pieces, in both chess and checkers a promotion feature is utilized in play as aforesaid. In typical embodiments of each of these games, the promotion of a piece occurs when it traverses the field of play in one direction. U.S. Pat. No. 4,019,746 to Hare, U.S. Pat. No. 4,032,152 to Johnson, and U.S. Pat. No. 5,340,114 to Wester, each reference promotion of pieces that are pawn-like and traverse a single game board in one direction to attain promotion. In the game of checkers, stacking of game pieces to designate promotion occurs under that game's rules by "kinging" the piece as is well known. This concept of stacking of pieces to designate promotion is disclosed in U.S. Pat. No. 4,032,152 to Shifman, U.S. Pat. No. 5,472,208 to Barry, U.S. Pat. No. 6,135,452 to Yurchey, and in U.S. Pat. Applic. Pub. No. 2001/0011798 of Anderson. In Shifman, so-called key markers are utilized for stacking on stationary posts positioned on a single game board. In Barry, opponents each have different game pieces, with one player having a set of rings and the other a set of peg-shaped pieces. The stacking action occurs upon capture of the opponent's piece. Yurchey describes two types of game pieces that may, in turn, be combined to achieve a more powerful third type of game piece with advanced movement and capture attributes. Anderson's game pieces have predefined movements and capture features, with predefined sets of movements for each piece. Stacking occurs when an opponent's piece is captured. The capturing piece adds the game piece and its attributes to its own movements. It is to be also noted that Yurchey utilizes the promotion and demotion of game pieces, by way of the aforedescribed concept of having two different types of pieces which may be combined in play to make the third, more powerful piece. Specifically, in Yurchey the two types of game pieces are positioned on a single-level game field, and they can be combined in play to attain the higher, third level of movement and capture attributes. Players may combine and un-combine the two types of pieces at will throughout the game. Promotions and demotions in Yurchey are not related, however, to pieces landing on predetermined promotion spaces on the board; and attaining promotion of a piece is not conditioned upon movement of the piece to another board.

Additionally, the prior, known games have relied upon generally cumbersome and rigid game board apparatuses. These constructions were typically not suited for compact storage and transportation, and they also had structural members such as support posts and the like which interfered with or obstructed play on portions of the boards adjacent to them.

Thus, despite past efforts, there has not been heretofore a hierarchical, multi-dimensional, strategy board game apparatus and playing method having an easily constructible and collapsible apparatus, and game pieces which, in play, attain promotion by ascending game board levels and may also be demoted by an opponent while effectively remaining in play.

SUMMARY OF THE INVENTION

An object of the present invention is to provide a hierarchical, multi-dimensional, strategy board game apparatus and playing method having an easily constructible and collapsible apparatus.

Another object of the present invention is to provide a hierarchical, multi-dimensional, strategy board game apparatus and playing method having game pieces which, in play, attain promotion by ascending game board levels.

A further object of the present invention is to provide a hierarchical, multi-dimensional, strategy board game apparatus and playing method having game pieces which, in play, may also be demoted by an opponent while effectively remaining in play.

In accordance with basic aspects of the present invention, a hierarchical, multi-dimensional, strategy board game apparatus includes game boards having game spaces, posts for supporting the board members, and game pieces including a static piece, a pawn-like piece, a first promotion piece, and a second promotion piece. In playing the game, a base board is designated, along with a riser space, a promotion space, and a return space. Each player starts with a designated number of pieces, and takes turns to move their pieces in prescribed ways via the designated spaces as available. The players thereby attempt to attain higher levels for their pieces with respect to the boards, with means for promotion and demotion of the pieces and an in-hand ability to return them to play via the return space. The pieces may thus gain expanded movement capabilities for capturing other players' pieces and, ultimately, the static piece to win the game.

BRIEF DESCRIPTION OF THE DRAWINGS

The present invention is illustrated by way of example and not limitation in the Figures of the accompanying drawings in which.

DETAILED DESCRIPTION OF THE INVENTION

Figure 1:
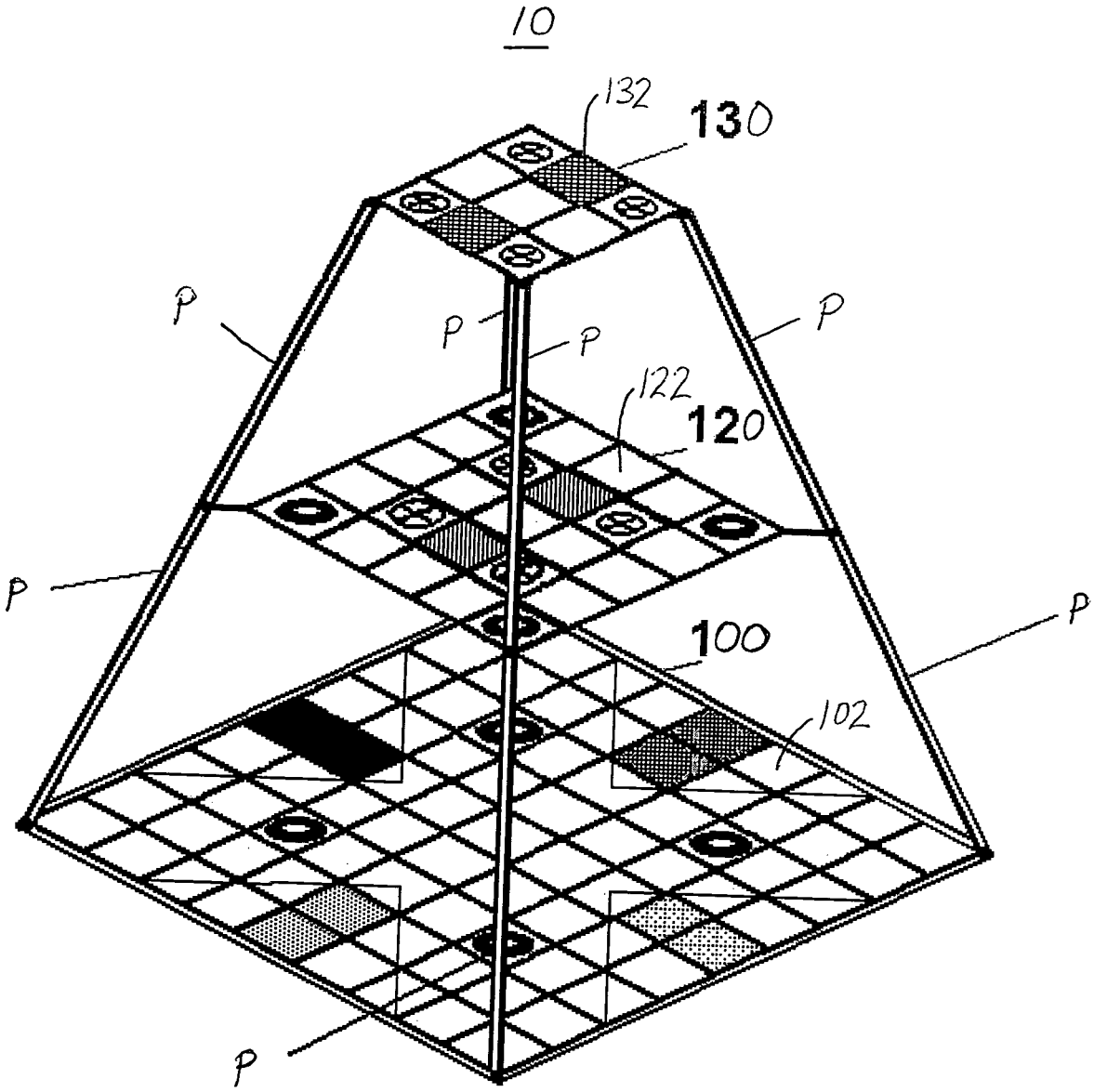
FIG. 1 is a perspective view of an exemplary hierarchical, multi-dimensional, strategy board game apparatus, constructed in accordance with the present invention.

FIGS. 1-8 illustrate an exemplary hierarchical, multi-dimensional, strategy board game apparatus and its components, in accordance with the present invention. This exemplary embodiment is commercially marketed under the present patent applicant's trademark "TRISE" (federal registration pending). Apparatus 10 includes a plurality of rectangular, substantially planar game board members 100, 120, and 130. Game board member 100 is designated as a base or first board, with game board members 120 and 130 being respectively designated as a middle or second board, and a top or third board. Exemplary board members 100, 120, and 130 each have a plurality of designated discrete game spaces 102, 122, and 132, respectively. Furthermore, with particular reference to FIGS. 3-5, among discrete game spaces 102-132 are (i) designated riser spaces 134*a* and 134*b*, and (ii) promotion spaces 136. It is to be understood that riser spaces 134*a* pertain to promotion and demotion of game pieces (described below) between game board members 100 and 120, while riser spaces 134*b* pertain to such movement between board members 120 and 130; the significance and use of riser spaces 134*a-b* and promotion spaces 136 in playing the game will be described in detail below.

Figure 2:
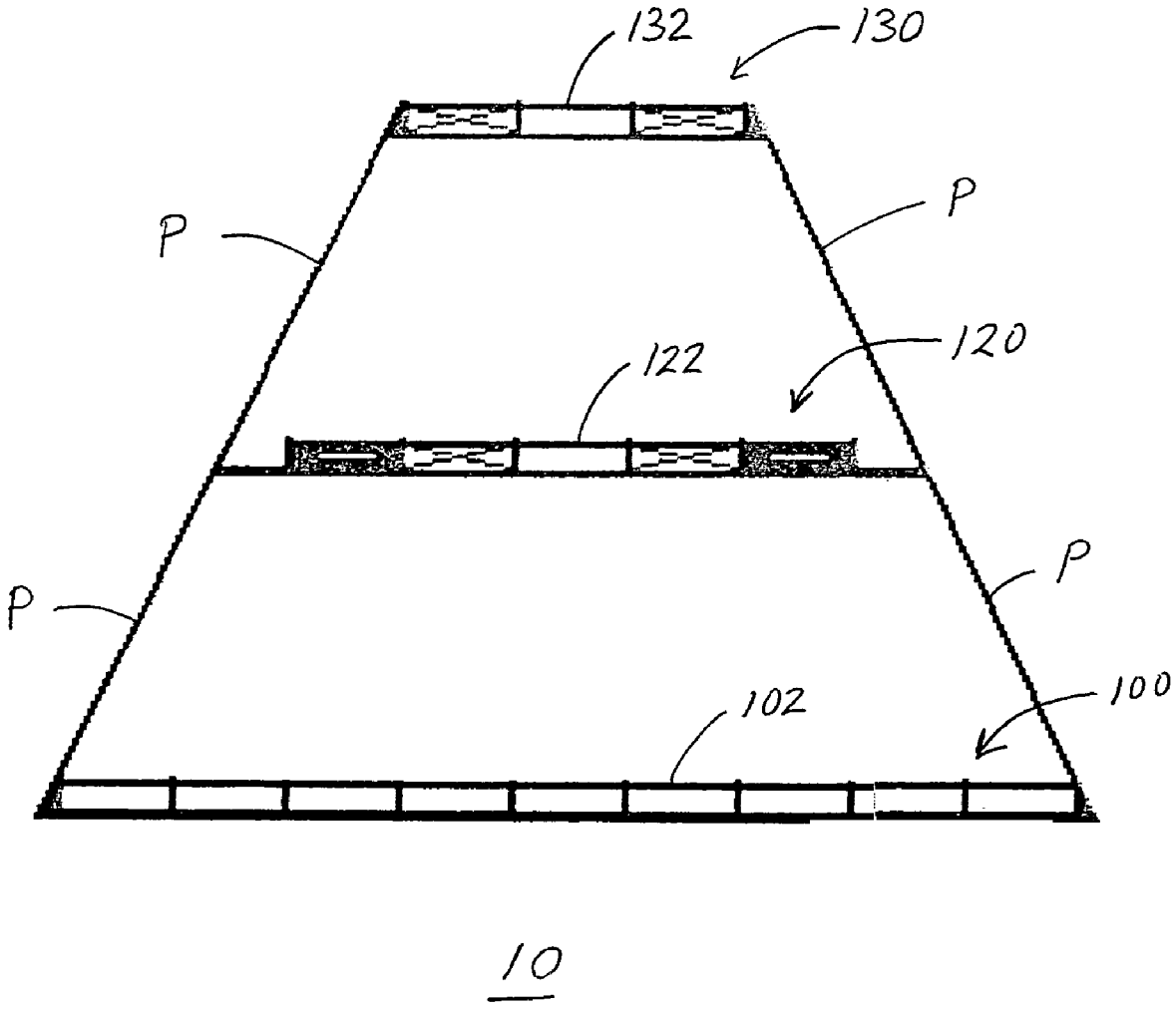
FIG. 2 is a reduced side view of the apparatus shown in FIG. 1.
Figure 5:
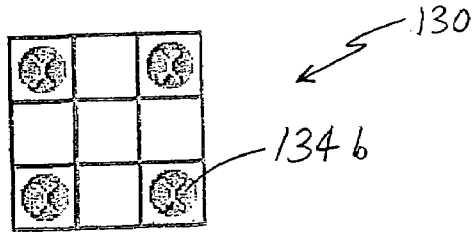
FIG. 5 is a plan view of a top or third board shown in FIGS. 1-2.
Figure 4:
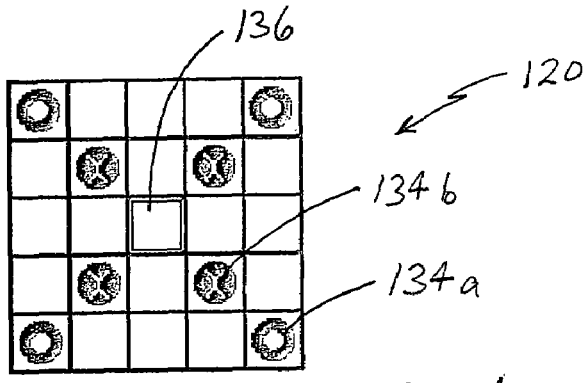
FIG. 4 is a plan view of a middle or second board shown in FIGS. 1-2.

As shown in FIGS. 1-2, apparatus 10 further includes a plurality of posts P. Posts P engage corners of game board members 100, 120, and 130, thereby supporting them in an aligned, hierarchical, vertical relationship relative to each other as is particularly evident in FIGS. 1 and 2. As shown, apparatus 10 preferably includes 8 posts P comprising two sets, with one set (of 4 posts P) for separating and aligning board members 100 and 120 and the other set (of 4 posts P) for separating and aligning board members 120 and 130.

Substantially planar game board members 100, 120, and 130 are preferably constructed from any suitable material, which may optionally be clear or translucent, such as an acrylic or plastic material. Of course, any sufficiently rigid material could be substituted therefore, having attributes which are useful to a substantially planar game board member. In a preferred embodiment, game board members 100-130 have dimensions of about 14.00 sq. in., 9.75 sq. in., and 5.50 sq. in., respectively. Posts P, which are hollow, are also preferably constructed from any suitable material (e.g., acrylic or plastic) which may optionally be clear or translucent; and any sufficiently rigid material could be substituted therefore, having attributes useful to posts P. They also each preferably contain a sufficiently short elastic bungee-type cord. Opposite ends of the cord extend beyond, respectively, opposite ends of a post to facilitate tying (not illustrated) into corner portions of the board members in any suitable, conventional manner. Although not illustrated, it is to be understood, then, that the elastic cord disposed throughout each post P acts to draw a given corner portion of each board member toward, to snugly and securely abut, a given end of the post. In a preferred embodiment, posts P have length dimensions of about 12.50 in. between board members 100 and 120, and about 5.75 in. between board members 120 and 130.

Figures 6A, 6B:
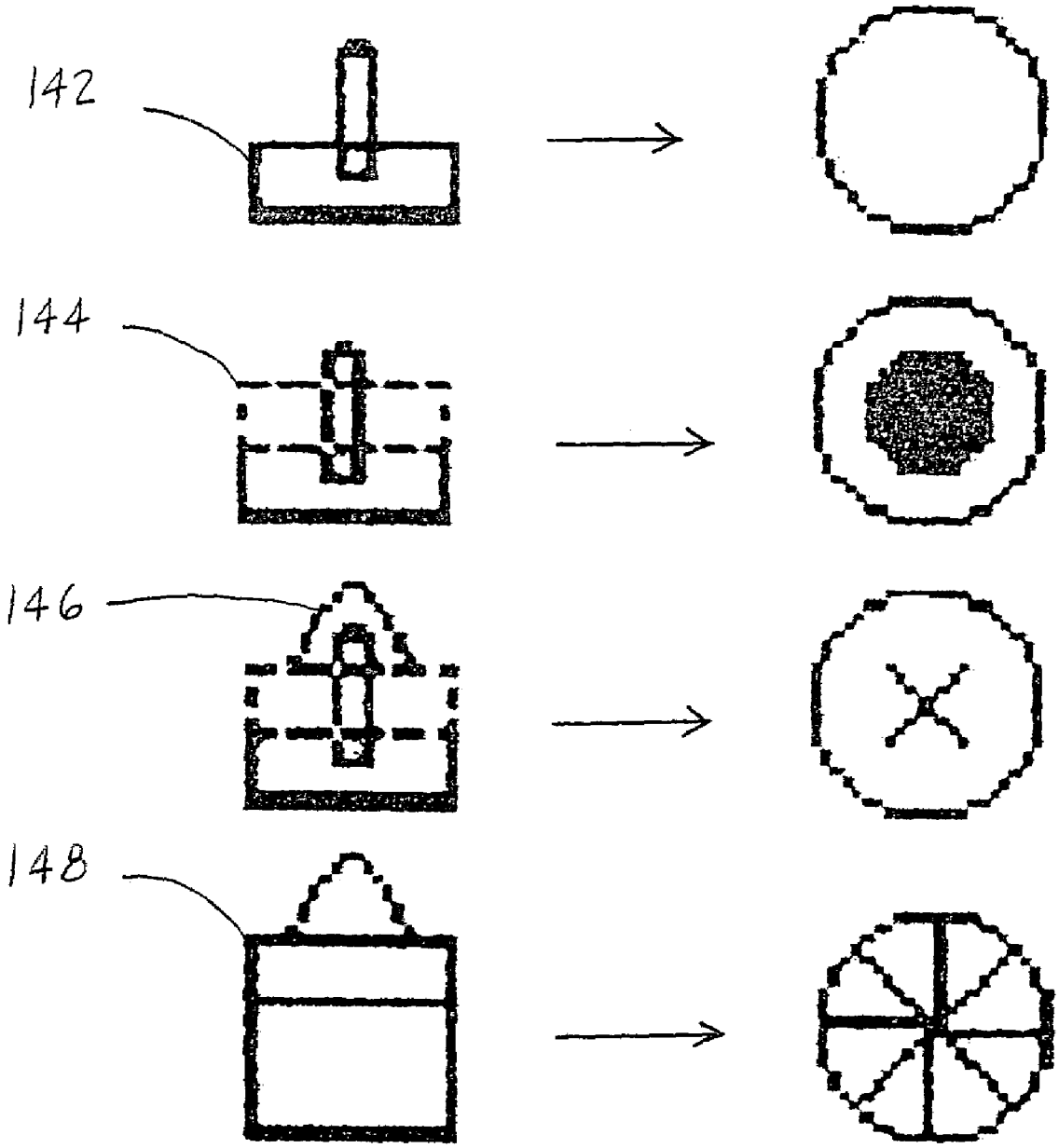
FIG. 6*a* is a side view of game pieces utilized with the apparatus shown in FIGS. 1-5.
FIG. 6*b* is a plan view legend of the pieces shown in FIG. 6*a*, relative to their placement on the board members of FIGS. 1-5.
Figure 7:
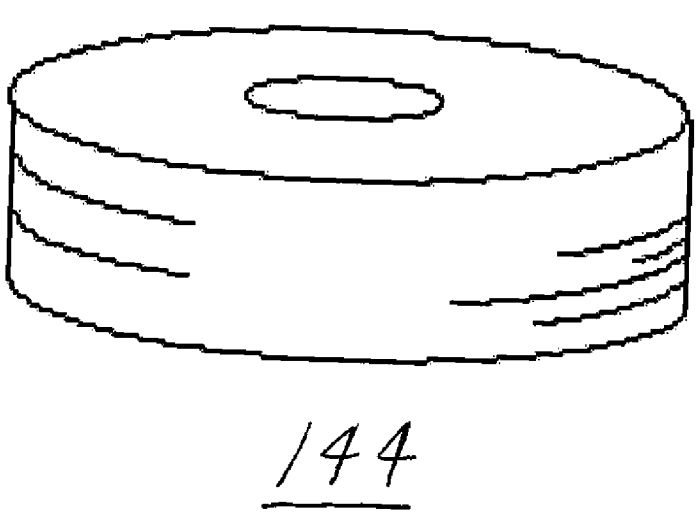
FIG. 7 is a magnified perspective view of two of the pieces shown in FIG. 6*a*.
Figure 7:
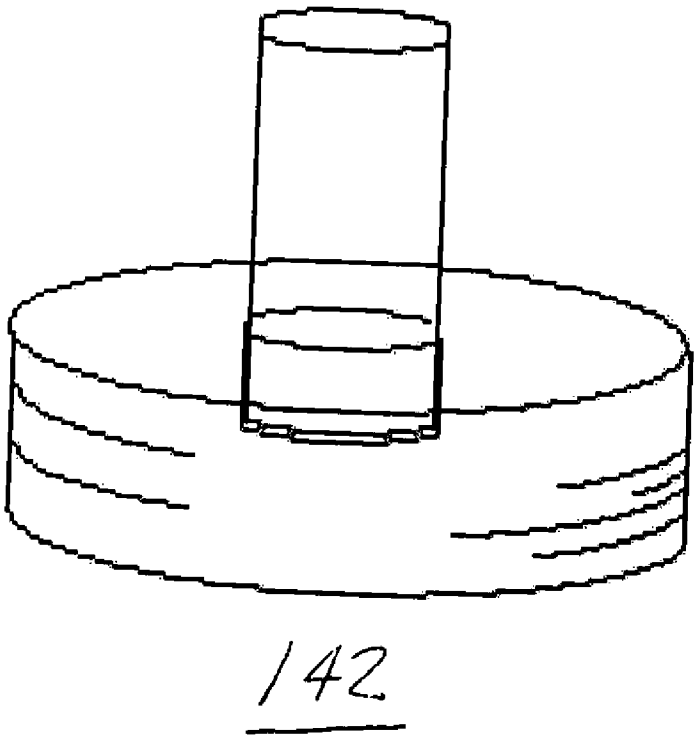
Figure 8:
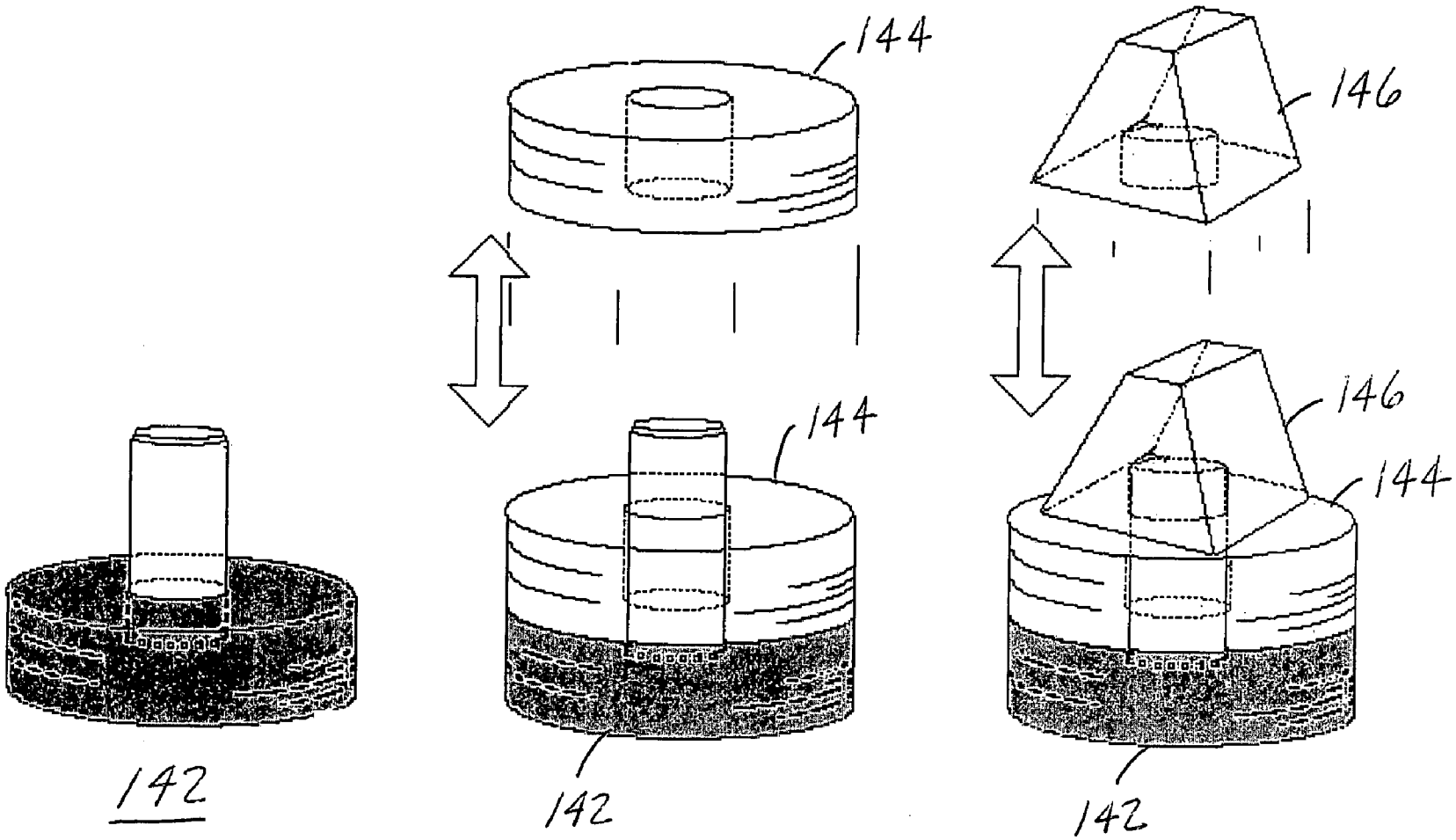
FIG. 8 is a magnified perspective view of three of the pieces shown in FIG. 6*a*.

A plurality of game pieces 140, including individual pieces 142, 144, 146, and 148 as shown in FIGS. 6*a*, 7, and 8, are provided for placement on board members 100, 120, and 130; these are referenced, in plan view, in the legend of FIG. 6*b*. Piece 142 is a pawn-like piece, with pieces 144 and 146 being a first promotion piece and a second promotion piece, respectively. Piece 148 is a static piece. Each piece 142 is configured to selectively receive a first promotion piece 144 and a second promotion piece 146, in stacking fashion.

Game pieces 140, like board members 100-130 and posts P, are preferably constructed from any suitable material such as acrylic or plastic, which may optionally be clear or translucent. But unlike board members 100-130 and posts P, game pieces 140 do not need to be, preferably, rigid.

It is to be understood that game spaces 102, 122, and 132 in game board members 100, 120, and 130, respectively, are each dimensioned to accommodate pawn-like pieces 142 and various combinations of those pieces 142 with stacked promotion pieces 144 and 146, and also static pieces 148.

Figure 1A:
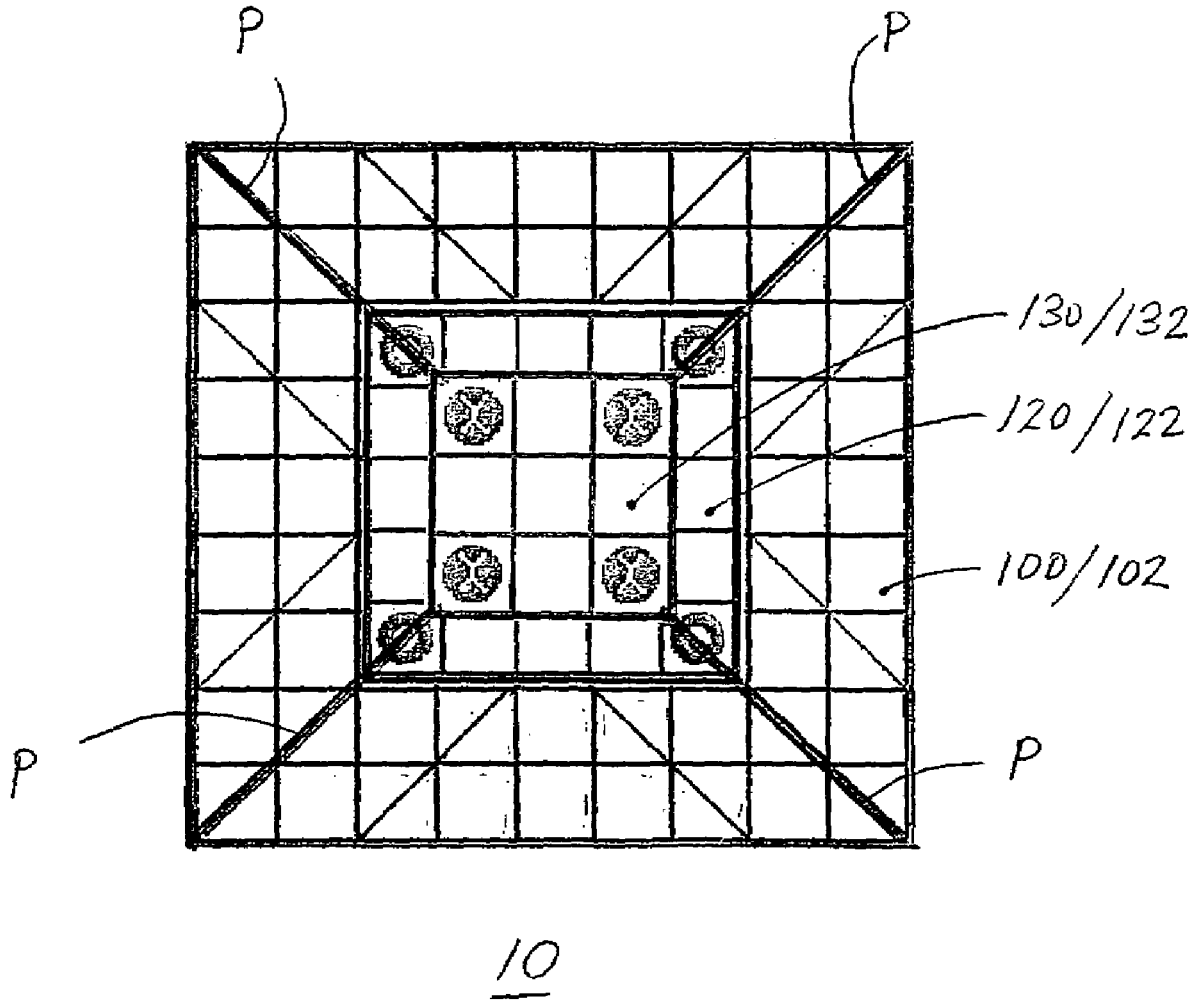
FIG. 1*a* is a reduced plan view of the apparatus shown in FIG. 1.

It is also to be understood that apparatus 10 is easily constructible and collapsible by way of posts P which engage and disengage, respectively, game board members 100, 120, and 130 as aforedescribed. Particularly, a collapsed condition of apparatus 10 may be easily visualized with respect to FIG. 1*a*. Posts P would be removed by way of untying or otherwise unfastening the elastic bungee-type cords from the corner portions of the board members, with board members 100-130 then being conveniently stacked on top of one another. In this manner, it will be appreciated, apparatus 10 is easily transportable and storable when not in use.

In the exemplary embodiment of the present invention, game board members 100-130, and game pieces 142-148, are selectively colored and selectively translucent, with any combinations of color and translucency being provided as desired. It would, of course, be advantageous in a preferred embodiment to ensure that the selected color and translucency attributes are consistent with separate game pieces 142-148 and a given number of players, and with selected portions of game board members 100-130 whereupon the separate players' game pieces are initially placed. It has been found, furthermore, by experimentation in development of apparatus 10, that fire polishing the selectively colored and translucent game board members and game pieces provides enhanced aesthetic appeal to apparatus 10.

Although not illustrated, but in another exemplary embodiment of apparatus 10, for even greater aesthetic appeal translucent board members 100-130 and game pieces 142-148 may be selectively lighted by any number of suitable techniques such as by way of miniature battery-operated light emitting diodes (LEDs) that may be implanted therein.

It is to be appreciated that the preferred embodiment of apparatus 10 is easily constructible and collapsible for compact storage and transportation. Also, it is to be appreciated that apparatus 10 is not dependent upon structural members which interfere with or obstruct play.

Figure 3:
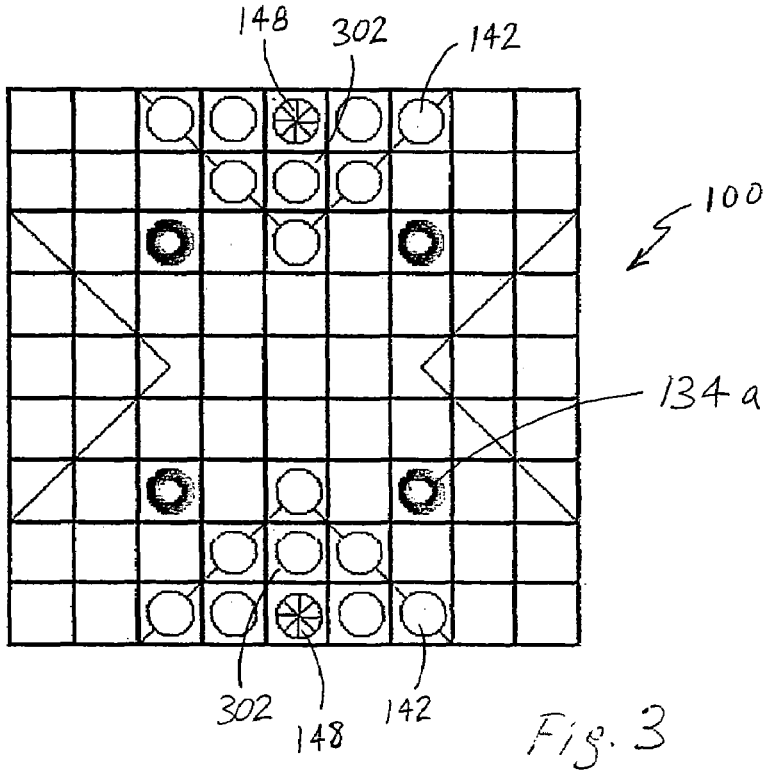
FIG. 3 is a plan view of a base or first board shown in FIGS. 1-2, including game pieces placed thereon.

Turning, now, to a method of playing the hierarchical, multi-dimensional, strategy board game of the present invention, apparatus 10 is provided as described in detail above. With apparatus 10 constructed from, perhaps, a collapsed condition by way of posts P, game board member 100 is designated as the base board and game board members 120 and 130 are respectively designated as the middle/second and top/third boards. Again, boards 100-130 each have a plurality of designated discrete game spaces 102-132, respectively, along with at least one designated riser space 134*a-b* and promotion space 136. Further, at least one return space 302 is designated in board 100 as shown in FIG. 3. In an exemplary method of playing the hierarchical, multi-dimensional, strategy board game of the present invention by two players, each player places one static piece 148 on base board 100 in a designated space 102 as shown in FIG. 3. Pawn-like game pieces 142 are then equally designated, divided, and arranged on base board 100 as shown in FIG. 3, one to each space 102 and surrounding static piece 148. The players are also provided with a designated number of first promotion pieces 144 and second promotion pieces 146 "in-hand". The players then take turns to move their pieces 142 in prescribed ways on board 100, and on boards 120 and 130 by selectively and strategically landing on unoccupied designated riser spaces 134*a-b* and promotion spaces 136. Upon being "knocked-off" as will be described, pieces 142 may be returned to base board 100 at each players' respective return space 302. Through such movements of their pieces, the players each attempt to attain higher levels for game pieces 142 with respect to game board members 120-130 and promotion pieces 144-146 corresponding thereto. It will be appreciated that the players' principal objective in playing the game of the present invention is to gain expanded movement capabilities of their pieces 142 through procurement of promotion pieces 144-146, thereby having a capability of strategically capturing the other player's pieces 142-146 and, ultimately, capturing the other player's static piece 148 and winning the game.

It is to be noted that in the exemplary method of playing the hierarchical, multi-dimensional, strategy board game of the present invention, a means is provided for demotion of game pieces with an "in-hand" ability to return them to play via a player's unoccupied return space 302. Specifically, if a game piece is attacked on middle/second board 120 or top/third board 130, the piece is not "captured" by the opponent but is rather "knocked-off" the board with any promotion pieces 144-146 possessed by that piece being removed and the piece being placed "in-hand" for return on a subsequent move via return space 302 in base board 100. This is the counterpoint to promotion, where the knocked-off piece is not lost but merely loses its progress toward promotion and may eventually be returned to play. In a preferred method of play, a knocked-off piece 142 may be returned to play by a player via an unoccupied return space 302 prior to making a move on any of the boards 100-130. Returning a piece to play does not itself count as a player's turn, and the player may then move the returned piece as that player's turn. Further in this preferred method of play, a "catch" is that if a player moves a piece 142-146 that is already on one of boards 100-130, return of an in-hand piece to an unoccupied return space 302 must then wait for a subsequent turn. It has been found that it is very easy to forget to do this which can thereby cause in certain circumstances a minor glut of unavailable pieces piled in-hand; and unintentionally stranding in-hand pieces in such manner can "tip a balance of power" in an opponent's favor.

Also in preferred rules of playing this exemplary board game of the present invention, two pawn-like pieces 142 are required for promotion of a given game piece on a promotion space 136 of middle/second board 120. Thereon, when a second piece 142 lands on the same promotion space 136, it is promoted by way of stacking on it a first promotion piece 144 and it remains on the promotion space. The other piece 142 goes in-hand and is allowed to return on base board 100 in an unoccupied return space 302. In this case, the in-hand and return processes are necessary steps in promoting game pieces. This rule may be conveniently remembered by the mnemonic "two to promote on the second board." Promotion on top/third board 130 is similar, but a previously promoted piece 144 and a pawn-like piece 142 must both land upon a promotion space 134*b* on top/third board 130. Then, piece 144 receives a "crown" promotion piece 146 and the pawn-like piece 142 goes in-hand. Here, the mnemonic is "three to promote on the third board."

In playing the game of the present invention, it will be seen that the promotion and demotion features create a cycle and balance that seems to be fairly intuitive (2 to promote at the 2nd level, and 3 (net) to promote at the 3rd level). Demotion can occur, but does not in itself cause an end to the game for that player. A central strategy of the game will become apparent, which is to maintain a balance of "resources": offensive game pieces, defensive game pieces, and those game pieces strategically selected to seek promotion. Promotion is a clear representation of progress and building power. Demotion is a set back, but is not an end in itself.

For further illustration, basic concepts involved in playing the aforementioned TRISE™ game, in accordance with the present invention, will now be briefly described as another exemplary method of playing the game.

The TRISE™ game is started with object piece 148 (the "Tellurian") and 8 single level, single movement pawn-like game pieces 142 (the "Plods") on base game board member 100. Base board member 100 contains 9×9 designated, discrete game spaces 102 (for a total of 81 discrete game spaces 102 thereon). Positioned above base board member 100 by a set of posts P is middle game board member 120 which contains 5×5 designated, discrete game spaces 122 (for a total of 25 discrete game spaces 122 thereon). Positioned above middle board member 120 by another set of posts P is top game board member 130 which contains 3×3 designated, discrete game spaces 132 (for a total of 95 discrete game spaces 132 thereon). In playing the TRISE™ game, players may move their game pieces, in turn, up to middle board member 120 and top board member 130. Such movement thereby attains, subject to the game's rules, promotion for a given Plod 142 (then being designated, respectively, as a "Biagonal" 144 and a "Tripex" 146). According to the rules, promotion of a Plod 142 to a Biagonal 144 and a Tripex 146 results in additional movement and capture features correspondingly. A Biagonal 144 has movement and capture capabilities that are somewhat analogous to a bishop in chess. A Tripex 146 has movement and capture capabilities that are somewhat analogous to a queen in chess. As aforementioned, the object of the TRISE™ game is to capture the opponent's Tellurian 148. Other pieces captured on base game board 100 are removed from play and do not return. However, Biagnoal 144 and Tripex 146 pieces captured by an opponent on the second and third game boards 120 and 130 are not removed from play but are rather (i) "knocked" out of play temporarily, (ii) returned to the opponent, (iii) demoted to a Plod 142, and (iv) allowed to return to play in a subsequent turn.

It is to be appreciated that the aforedescribed method of playing the game of the present invention conveys a generally positive message, which from research and observation is apparently understood by even young and relatively unsophisticated players. Specifically, game pieces going "in-hand" are just temporarily sidelined, with their return to action being subject to the discretion and strategy of an individual player. As a result, the game is typically lively with a balance of power frequently changing between opponents. Research and observation have also found that many players find the game to be a metaphor for life, business, and any number of worthwhile pursuits. It is also to be noted from the foregoing description of a preferred, exemplary embodiment, that the TRISE™ playing method of the present invention is intuitive since it broadly relates to "sets of three". In this regard, the TRISE™ game combines (i) three levels of three game boards as, collectively, a field of play, (ii) three-level game pieces, and (iii) the promotion and demotion features of the game pieces among the three levels of boards. In the TRISE™ game, it is to be understood, clever strategy is required of a successful player beyond that which is required in conventional, single level, board games, since the game of the present invention includes a demotion feature which results in a previously promoted piece being potentially sent back down, hierarchically, to the base board as a first level game piece but remaining in play.

While the present invention has been particularly shown and described with reference to the accompanying figures and specification, it will be understood however that other modifications thereto are of course possible; and all of which are intended to be within the true spirit and scope of the present invention.

It should be appreciated that components, dimensions, rules, and other particulars and parameters of exemplary embodiments and methods of the invention aforedescribed may be substituted for others as desired or which are suitable for achieving desired results, or that various accessories may be added thereto.

It is also to be understood in general that any suitable alternatives may be employed to provide the hierarchical, multi-dimensional, strategy board game apparatus and playing method of the present invention.

Lastly, of course, the choice of compositions, sizes, and strengths of various aforementioned elements of the apparatus of the present invention are all a matter of design choice depending upon intended uses thereof.

Accordingly, these and other various changes or modifications in form and detail of the present invention may also be made therein, again without departing from the true spirit and scope of the invention as defined by the appended claims.

What is claimed is:

1. A strategy board game having a two or more game boards wherein the object of the game is for a first player to utilize game pieces of the first player to capture at least a second player's protected game piece, and prevent capture of it's own protected game piece by the second player's game pieces, and where game pieces may be selectively moved to game board game spaces in accordance with predetermined rules in directions aligned with rows, columns, diagonals, and between game boards, and where game pieces may be promoted, demoted, and returned to play in accordance with predetermined rules, the strategy game board comprising:

at least a first, second, and third game boards, each configured to establish a matrix of game spaces along rows and columns, where, (i) the first game board, designated as a Main Level, includes a matrix of game spaces defined by N-rows and N-columns, where N is an odd integer equal to or greater than 9, and includes, one or more designated riser game spaces, and at least one designated entry zone game space for each player, and where game pieces captured on the Main Level are removed from the game, (ii) the second game board, designated as a Biag Level, includes a matrix of game spaces defined by X-rows and X-columns, where X is an odd integer equal to or greater than 5 and less than N, and includes, one or more first designated riser game spaces, each corresponding to only one of said designated riser game spaces on said Main Level, and permitting game piece movement to and from said first designated riser space on said Biag Level and said corresponding designated space on said Main Level, one or more second designated riser game spaces, and one or more designated Biag promotional game spaces, and where game pieces captured on the Biag Level may be returned to play on the Main Level on an unoccupied player's entry zone game space on a subsequent player's turn, (iii) the third game board, designated as a Triad Level, includes said a matrix of game spaces defined by Y-rows and Y-columns, and where Y is an odd integer equal to or greater than 3 and less than X, and includes, one or more designated riser game spaces, each corresponding to only one of said second designated riser game spaces on said Biag Level, and permitting game piece movement to and from said designated riser space on said Triad Level and said corresponding second designated space on said Biag Level, and one or more designated Triad promotional game spaces, and where game pieces captured on the Triad Level may be returned to play on the Main Level on an unoccupied player's entry zone game space on a subsequent player's turn;

a plurality of game pieces defining a set of game pieces associated with a player, where each game piece has a visually distinguishable feature that differs from one another, said set of plurality of game pieces includes, (i) a first game piece designated the Tellurian serving as the player's protected game piece intended to be protected from capture, said Tellurian being permitted during a player's turn to, a) move on the main level from its current position to one unoccupied game space away in any direction, and b) capture an opponent's game piece by movement in any direction from its current position to a game space occupied by an opponent's game piece, (ii) a second game piece designated the Plod, said Plod being permitted during a player's turn to, a) move from its current position one game space away in any direction, and b) capture an opponent's game piece by movement diagonally from its current position to a game space occupied by an opponent's game piece, c) return to a player's unoccupied entry zone game space on the Main Level if previously captured by an opponent on the Biag Level or Triad Level, (iii) a third game piece designated the Biagonal, said Biagonal being permitted during a player's turn to, a) move from its current position diagonally to a game space any number of unoccupied game spaces away, and b) move from its current position to one unoccupied game space away in any direction, and c) capture an opponent's game piece by movement diagonally from its current position to a game space occupied by an opponent's game piece, and d) return to a player's unoccupied entry zone game space on the Main Level as a Plod, if previously captured by an opponent on the Biag Level or Triad Level, where the Biagonal game piece is achieved by promotion of two Plods of a player landing on a selected promotional game space on the Biag Level, and permitting, on a subsequent turn and prior to any other game piece move, the return of one of the aforesaid two Plods to a player's unoccupied entry zone game space on the Main Level;

(iv) a fourth game piece designated the Tripex, said Tripex being permitted during a player's turn to, a) move from its current position any number of unoccupied game spaces in any direction, b) capture an opponent's game piece by movement from its current position in any direction to a game space occupied by an opponent's game piece, and c) return to a player's unoccupied entry zone game space on the Main Level as a Plod, if previously captured by an opponent on the Biag Level or Triad Level, and where the Tripex game piece is achieved by promotion of a) one Plod and one Biagonal of a player landing on a selected promotional space on the Triad Level, or b) Two Biagonals of a player landing on a selected promotional game space on the Triad Level, and where on a subsequent turn the promoted Biag or Plod is permitted to return to a player's unoccupied entry zone game space on the Main Level; and where said strategy game begins with each player having one Tellurian and a plurality of Plods grouped together on a selected side of the Main Level game board, and where play continues until only one Tellurian remains.

2. The strategy board game of claim 1 is selectively constructible and collapsible by way of said plurality of posts which engage and disengage, respectively, said first, second, and third substantially planar game boards.

3. The strategy board game of claim 1, wherein said game boards are selectively colored.

4. The strategy board game of claim 3, wherein said game boards are selectively translucent.

5. The strategy board game of claim 4, wherein said planar game boards members are selectively lighted.

6. The strategy board game of claim 1, wherein said game boards are selectively translucent.

7. The strategy board game of claim 6, wherein said planar game boards members are selectively lighted.

8. The strategy game board of claim 1 wherein each of said first, second, and third game boards is defined by an odd number of rows and columns.

9. The strategy game board of claim 1 wherein said first, second, and third game boards are planar boards arranged in a three-dimensional pyramid-like structure where said first game board is the bottom board, and said third game board is the top game board.

10. A method of playing a strategy board game wherein the object of the game is for a first player to utilize game pieces of the first player to capture at least a second player's protected game piece, and prevent capture of it's own protected game piece by the second player's game pieces, and where game pieces may be selectively moved to game board game spaces in accordance with predetermined rules in directions aligned with rows, columns, diagonals, and between game boards, and where game pieces may be promoted, demoted, and returned to play in accordance with predetermined rules, the strategy game board method comprising the steps of:

providing at least a first, second, and third game boards, each configured to establish a matrix of game spaces along rows and columns, where, (i) the first game board designated as a Main Level includes, one or more designated riser game spaces, and at least one designated entry zone space for each player, and where game pieces captured thereon are removed from the game, (ii) the second game board designated as a Biag Level includes, one or more first designated riser game spaces, each corresponding to only one of said designated riser game spaces on said Main Level, and permitting game piece movement to and from said first designated riser space on said Biag Level and said corresponding designated space on said Main Level, one or more second designated riser game spaces, and one or more designated Biag promotional game spaces, and where game pieces captured on the Biag Level may be returned to play on the Main Level on an unoccupied player's entry zone game space on a subsequent player's turn, (iii) the third game board designated as a Triad Level includes, one or more designated riser game spaces, each corresponding to only one of said second designated riser game spaces on said Biag Level, and permitting game piece movement to and from said designated riser space on said Triad Level and said corresponding second designated space on said Biag Level, and one or more designated Triad promotional game spaces, and where game pieces captured on the Triad Level may be returned to play on the Main Level on an unoccupied player's entry zone game space on a subsequent player's turn, assigning movement limitations and capabilities to a plurality of game pieces associated with each player, each game piece having a visually distinguishable feature, and game pieces associated with a game player having a common visually distinguishable feature, said game pieces including, (i) a first game piece designated the Tellurian serving as the player's protected game piece intended to be protected from capture, said Tellurian being permitted during a player's turn to, a) move on the main level from its current position to one unoccupied game space away in any direction, and b) capture an opponent's game piece by movement in any direction from its current position to a game space occupied by an opponent's game piece, (ii) a second game piece designated the Plod, said Plod being permitted during a player's turn to, a) move from its current position one game space away in any direction, b) capture an opponent's game piece by movement diagonally from its current position to a game space occupied by an opponent's game piece, and c) return to a player's unoccupied entry zone on the Main Level, if previously captured by an opponent on the Biag Level or Triad Level, (iii) a third game piece designated the Biagonal, said Biagonal being permitted during a player's turn to, a) move from its current position diagonally to a game space any number of unoccupied game spaces away, b) move from its current position to one unoccupied game space away in any direction, c) capture an opponent's game piece by movement diagonally from its current position to a game space occupied by an opponent's game piece, and d) return to a player's unoccupied entry zone game space on the Main Level as a Plod, if previously captured by an opponent on the Biag Level or Triad Level, where the Biagonal game piece is achieved by promotion of two Plods of a player landing on a selected promotional space on the Biag Level, and permitting one Plod to return to a player's unoccupied entry zone game space on the a subsequent turn;

(iv) a fourth game piece designated the Tripex, said Tripex being permitted during a player's turn to, a) move from its current position any number of unoccupied game spaces in any direction, b) capture an opponent's game piece by movement from its current position in any direction to a game space occupied by an opponent's game piece, c) return to a player's unoccupied entry zone game space on the Main Level as a Plod, if previously captured by an opponent on the Biag Level or Triad Level where the Tripex game piece is achieved by promotion of a) one Plod and one Biagonal of a player landing on a selected promotional space on the Triad Level, or b) Two Biagonals of a player landing on a selected promotional game space on the Triad Level, and where on a subsequent turn a selected game piece is permitted to return to a player's unoccupied entry zone game space on the Main Level; and where said strategy game begins with each player having one Tellurian and a plurality of Plods grouped together on a selected side of the Main Level game board, and where play continues until only one Tellurian remains.

11. The strategy game board method of claim 10 wherein said first, second, and third game boards are planar boards arranged in a three-dimensional pyramid-like structure where said first game board is the bottom board, and said third game board is the top game board.

12. The strategy game board of claim 10 wherein said first, second, and third game boards are planar boards arranged in a three-dimensional pyramid-like structure where said first game board is the bottom board, and said third game board is the top game board, and where, said first game board provides a matrix of game spaces defined by N-rows and N-columns, said second game board provides a matrix of game spaces defined by X-rows and X-columns, and said third game board provides a matrix of game spaces defined by Y-rows and Y-columns.

13. The strategy game board of claim 12 where N is an odd integer equal to or greater than 9, and X is an odd integer equal to or greater than 5 and less than N, and Y is an odd integer equal to or greater than 3 and less than X.

14. The strategy game board of claim 13 wherein said first, second, and third game boards are planar boards arranged in a three-dimensional pyramid-like structure where said first game board is the bottom board, and said third game board is the top game board, and where, said first game board provides a matrix of game spaces defined by N-rows and N-columns, said second game board provides a matrix of game spaces defined by X-rows and X-columns, and said third game board provides a matrix of game spaces defined by Y-rows and Y-columns.

15. The strategy game board of claim 10 where said Plods have a generally disc shape with a central post adapted to receive a generally disc shaped piece, and a generally trapezoidal shape piece such that said Plod may be promoted to said Biagonal by way of first receiving said disc shaped piece, and said Biagonal may be promoted to said Tripex by way of receiving said trapezoidal shaped piece on top of said disc shaped piece.

16. The strategy game board of claim 10 where said first designated riser space is located at each corner of said second game board, and said designated riser space of said third game board is located at each corner of said third game board.

17. A strategy board game having a two or more game boards wherein the object of the game is for a first player to utilize game pieces of the first player to capture at least a second player's protected game piece, and prevent capture of it's own protected game piece by the second player's game pieces, and where game pieces may be selectively moved to game board game spaces in accordance with predetermined rules in directions aligned with rows, columns, diagonals, and between game boards, and where game pieces may be promoted, demoted, and returned to play in accordance with predetermined rules, the strategy game board comprising:

at least a first, second, and third game boards, each configured to establish a matrix of game spaces along rows and columns, where, (i) the first game board, designated as a Main Level, includes, one or more designated riser game spaces, and at least one designated entry zone game space for each player, and where game pieces captured on the Main Level are removed from the game, (ii) the second game board, designated as a Biag Level, includes, one or more first designated riser game spaces, each corresponding to only one of said designated riser game spaces on said Main Level, and permitting game piece movement to and from said first designated riser space on said Biag Level and said corresponding designated space on said Main Level, one or more second designated riser game spaces, and one or more designated Biag promotional game spaces, and where game pieces captured on the Biag Level may be returned to play on the Main Level on an unoccupied player's entry zone game space on a subsequent player's turn, (iii) the third game board, designated as a Triad Level including, one or more designated riser game spaces, each corresponding to only one of said second designated riser game spaces on said Biag Level, and permitting game piece movement to and from said designated riser space on said Triad Level and said corresponding second designated space on said Biag Level, and one or more designated Triad promotional game spaces, and where game pieces captured on the Triad Level may be returned to play on the Main Level on an unoccupied player's entry zone game space on a subsequent player's turn;

a plurality of game pieces defining a set of game pieces associated with a player, where each game piece has a visually distinguishable feature that differs from one another, said set of plurality of game pieces including, (i) a first game piece designated the Tellurian serving as the player's protected game piece intended to be protected from capture, said Tellurian being permitted during a player's turn to, a) move on the main level from its current position to one unoccupied game space away in any direction, and b) capture an opponent's game piece by movement in any direction from its current position to a game space occupied by an opponent's game piece, (ii) a second game piece designated the Plod having a generally disc shape with a central post adapted to receive a generally donut shaped piece and a generally trapezoidal shape piece, said Plod being permitted during a player's turn to, a) move from its current position one game space away in any direction, and b) capture an opponent's game piece by movement diagonally from its current position to a game space occupied by an opponent's game piece, c) return to a player's unoccupied entry zone game space on the Main Level if previously captured by an opponent on the Biag Level or Triad Level, (iii) a third game piece designated the Biagonal, where said Plod may be promoted to a Biagonal by way of receiving the donut shaped disc upon the post of the Plod, and where said Biagonal is permitted during a player's turn to, a) move from its current position diagonally to a game space any number of unoccupied game spaces away, and b) move from its current position to one unoccupied game space away in any direction, and c) capture an opponent's game piece by movement diagonally from its current position to a game space occupied by an opponent's game piece, and d) return to a player's unoccupied entry zone game space on the Main Level as a Plod, if previously captured by an opponent on the Biag Level or Triad Level, where the Biagonal game piece is achieved by promotion of two Plods of a player landing on a selected promotional game space on the Biag Level, and permitting, on a subsequent turn and prior to any other game piece move, the return of one of the aforesaid two Plods to a player's unoccupied entry zone game space on the Main Level, and (iv) a fourth game piece designated the Tripex, where said Biagonal may be promoted to a Tripex by way of receiving the trapezoidal shaped piece upon the post on top of the donut shaped disc, and where said Tripex is permitted during a player's turn to, a) move from its current position any number of unoccupied game spaces in any direction, b) capture an opponent's game piece by movement from its current position in any direction to a game space occupied by an opponent's game piece, and c) return to a player's unoccupied entry zone game space on the Main Level as a Plod, if previously captured by an opponent on the Biag Level or Triad Level, and where the Tripex game piece is achieved by promotion of, a) one Plod and one Biagonal of a player landing on a selected promotional space on the Triad Level, or b) two Biagonals of a player landing on a selected promotional game space on the Triad Level, and where on a subsequent turn the promoted Biag or Plod is permitted to return to a player's unoccupied entry zone game space on the Main Level; and where said strategy game begins with each player having one Tellurian and a plurality of Plods grouped together on a selected side of the Main Level game board, and where play continues until only one Tellurian remains.

18. The strategy game board of claim 17 wherein said first, second, and third game boards are planar boards arranged in a three-dimensional pyramid-like structure where said first game board is the bottom board, and said third game board is the top game board, and where, said first game board provides a matrix of game spaces defined by N-rows and N-columns, said second game board provides a matrix of game spaces defined by X-rows and X-columns, and said third game board provides a matrix of game spaces defined by Y-rows and Y-columns.

19. The strategy game board of claim 18 where N is an odd integer equal to or greater than 9, and X is an odd integer equal to or greater than 5 and less than N, and Y is an odd integer equal to or greater than 3 and less than X.

20. The strategy game board of claim 19 where said first designated riser space is located at each corner of said second game board, and said designated riser space of said third game board is located at each corner of said third game board.

21. A method of playing strategy board game wherein the object of the game is for a first player to utilize game pieces of the first player to capture at least a second player's protected game piece, and prevent capture of it's own protected game piece by the second player's game pieces, and where game pieces may be selectively moved to game board game spaces in accordance with predetermined rules in directions aligned with rows, columns, diagonals, and between game boards, and where game pieces may be promoted, demoted, and returned to play in accordance with predetermined rules, the strategy game board method comprising the steps of:

providing at least first game board establishing a Main Level, and at least one higher level game board, each configured to establish a matrix of game spaces along rows and columns, where, (i) the first game board, designated as the Main Level, includes, one or more designated riser game spaces, and at least one designated entry zone game space for each player, and where game pieces captured on the Main Level are removed from the game, (ii) the one higher level game board, designated the Biag Level, includes, one or more first designated riser game spaces, each corresponding to only one of said designated riser game spaces on the Main Level, and permitting game piece movement to and from said first designated riser game spaces on said Biag Level and said corresponding designated riser game spaces on the Main Level, and one or more designated Biag promotional game spaces, and where game pieces captured on the Biag Level may be returned to play on the Main Level on an unoccupied player's entry zone game space on a subsequent player's turn, assigning movement limitations, rules, and capabilities to a plurality of game pieces associated with each player, each game piece having a visually distinguishable feature, and game pieces associated with a game player having a common visually distinguishable feature, said game pieces including, (i) a first game piece designated the Tellurian serving as the player's protected game piece intended to be protected from capture, said Tellurian being permitted during a player's turn to, a) move from its current position according to defined directional movement capabilities, and b) capture an opponent's game piece by movement in any direction from its current position to a game space occupied by an opponent's game piece, (ii) at least a second game piece designated a Plod being permitted during a player's turn to, a) move from its current position according to defined directional movement capabilities, b) capture an opponent's game piece in accordance with defined directional movements from it's current position to a game space occupied by an opponent's game piece, and c) return to a player's unoccupied entry zone game space on the Main Level, if previously captured by an opponent on the higher level game boards, (iii) a third game piece designated the Biagonal, said Biagonal being permitted during a player's turn to, a) move from its current position according to defined directional movement capabilities, and b) capture an opponent's game piece by movement it's current position to a game space occupied by an opponent's game piece in accordance with a define modality, and c) return to a player's unoccupied entry zone game space on the Main Level as a Plod, if previously captured by an opponent on the higher level game boards, where the Biagonal game piece is achieved by promotion of two Plods of a player landing on a selected promotional space on the Biag Level, and permitting one Plod to return to a player's unoccupied entry zone space on the Main Level on a subsequent turn; and where said strategy game begins with each player having one Tellurian and a plurality of Plods grouped together on a selected side of the Main Level game board, and where a player's game pieces are selectively promoted and returned to the Main Level in accordance with a set of rules, and captured game pieces on higher level game boards other than the Main Level are demoted and selectively returned to the Main Level.

* * * * *